US006257688B1

(12) United States Patent
Kubo

(10) Patent No.: US 6,257,688 B1
(45) Date of Patent: Jul. 10, 2001

(54) INK JET RECORDING APPARATUS

(75) Inventor: Tomoyuki Kubo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/058,573

(22) Filed: Apr. 10, 1998

(30) Foreign Application Priority Data

Apr. 10, 1997 (JP) ..... 9-110273

(51) Int. Cl.[7] ..... B41J 2/01
(52) U.S. Cl. ..... 347/11; 347/14
(58) Field of Search ..... 347/10, 11, 14, 347/17, 19

(56) References Cited

U.S. PATENT DOCUMENTS 5,736,994 * 4/1998 Takahashi ..... 347/11
5,774,137 * 6/1998 Yoshida ..... 347/14
5,980,013 * 11/1999 Takahashi ..... 347/14

FOREIGN PATENT DOCUMENTS 63-247051 10/1988 (JP) .

* cited by examiner

*Primary Examiner*—John Barlow
*Assistant Examiner*—Craig A. Hallacher
(74) *Attorney, Agent, or Firm*—Oliff & Berridge, PLC

(57) ABSTRACT

An ink jet recording apparatus of the shear mode type includes a recording head having a nozzle and, when a drive pulse signal is supplied thereto, driven to expel, from the nozzle, an ink supplied from an ink supply onto a recording medium so that recording is executed, a driver for supplying the pulse signal to the recording head, a temperature sensor for detecting an ambient temperature, and a control for changing the drive pulse signal corresponding to one record data on the basis of the ambient temperature detected by the temperature sensor.

11 Claims, 12 Drawing Sheets

100

| AMBIENT TEMPERATURE T | PULSE NUMBER N |
|---|---|
| $T \leqq 15°C$ | 3 |
| $15°C < T < 35°C$ | 2 |
| $T \geqq 35°C$ | 1 |

F I G. 4

INK JET RECORDING APPARATUS

BACKGROUND OF THE INVENTION

1. Field of the Invention

This invention relates to an ink jet recording apparatus ejecting ink from a nozzle onto a recording medium such as recording paper, thereby executing recording.

2. Description of the Related Art

Ink jet recording apparatuses of the shear mode type using a piezoelectric ceramic material are known as those of the drop-on-demand type. For example, Japanese patent publication No. 63-247051 (1988) discloses one of such ink jet recording apparatuses. FIGS. 9A to 10 show a recording head used in the ink jet recording apparatus of the shear mode type. FIG. 9A is a sectional view taken along a plane crossing the length of an ink chamber of the recording head. The recording head 21 includes a cover plate 201 and a base plate 202 opposed to the cover plate 201. A plurality of shear mode wall actuators 203 are provided between the cover plate 201 and the base plate 202. Each of the shear mode wall actuators 203 is polarized in the directions of arrows F3 and F4 in FIG. 9A. An ink chamber 205 and an air chamber 212 are alternately formed between each shear mode wall actuator 203 and the adjacent one. Each shear mode wall actuator 203 has membrane electrodes 204 and 214 formed on opposite side faces thereof respectively.

FIG. 9B is a sectional view taken along the length of the recording head 21. A nozzle plate 207 is mounted to front ends of the shear mode wall actuators 203. The nozzle plate 207 is formed with nozzles 206 communicating with the ink chambers 205 respectively. A manifold 209 is mounted to rear ends of the shear mode wall actuators 203. The manifold 209 has a filler 208 preventing ink in an ink channel 213 from penetrating the air chamber 212. The manifold 209 distributes the ink from an ink tank or ink supply into the ink chambers 205. The electrodes 204 and 214 are covered with respective insulating layers (not shown) so as to be insulated from the ink. The electrodes 214 facing the respective air chambers 212 are connected to an earth line 211. The electrodes 204 formed in the respective ink chambers 205 are connected to a head driver IC 83 for applying actuator drive signals to the electrodes 204 and 214.

The following describes the relationship between the timing for application of the drive pulse signal to the recording head and the pressure induced in the vicinity of the nozzle 206 in the ink chamber 205 by the application of the drive pulse signal. In the above-described construction, a drive pulse signal is supplied to the recording head when one record data, for example, one dot of record data is recorded. The drive pulse signal corresponding to one record data is composed of two drive pulses (multipulse). The above-mentioned drive pulse signal has a drive frequency of 10.8 kHz, for example (ejection interval of 93 $\mu$sec).

The head driver IC 83 applies a first drive pulse 110*a* with a waveform as shown in FIG. 11 to the electrode 204. An electric field with a direction of arrows F1 in FIG. 10 is then induced in the left-hand side shear mode wall actuator 203, and an electric field with a direction of arrows F2 is induced in the right-hand side shear mode wall actuator 203. Consequently, both shear mode wall actuators 203 are subjected to piezoelectric sliding deformation so that the volume of the ink chamber 205 is increased. Pressure is decreased in the vicinity of the nozzle 206 in the ink chamber 205 such that meniscus 230 is withdrawn into the ink chamber 205 (at time T1), as shown in FIG. 12B. This state is maintained for a one-way propagation time T of pressure wave in the ink chamber 205 (pulse width of the first drive pulse 110*a*). This effects supply of the ink from the ink channel 213 during the maintenance of the above-described state.

The one-way propagation time T is required for the pressure wave in the ink chamber 205 to propagate in the direction of length of the ink chamber 205. The one-way propagation time T depends upon the length L (see FIG. 9B) of the ink chamber 205 and sound speed a in the ink in the ink chamber 205, that is, T=L/a. According to the theory of pressure wave propagation, the pressure in the ink chamber 205 is changed to positive pressure upon elapse of the time T from the time of application of the drive pulse 110*a*. The drive voltage applied to the electrode 204 of the ink chamber 205 is returned to zero in synchronism with the change to the positive pressure (at time T2).

Then, each shear mode wall actuator 203 is returned to the former state (see FIG. 9A), whereupon pressure is applied to the ink. Since pressure resulting from the return of each shear mode wall actuator 203 to the former state is added to the above-mentioned positive pressure, a relatively high pressure is induced in the vicinity of the nozzle 206 of the ink chamber 205. Consequently, the meniscus 230 is ejected as ink droplets 232 from the nozzle 206 at a predetermined speed, as shown in FIG. 12A. After the ejection, another meniscus comes out of the opening of the nozzle as shown in FIG. 12A.

Subsequently, a second drive pulse 110*b* is applied to the electrode 204 upon elapse of the one-way propagation time T from the fall of the first drive pulse 110*a*, that is, at time T3 so that ink droplets are ejected. The second drive pulse 110*b* has the same peak value (amplitude) as the first drive pulse 110*a* and a pulse width equal to the one-way propagation time T. The drive pulse signal 110 is thus applied to the recording head 21 in synchronism with input of the record data so that the ink droplets are ejected onto a recording medium such as recording paper, whereby recording is executed.

The viscosity of the ink used in the ink jet recording apparatus changes according to an ambient temperature. FIG. 8 shows the relationship between the ambient temperature of the ink and the ink viscosity. For example, the viscosity of the ink is about 3 mPa·s at the temperature of 25° C. However, the viscosity changes to about 6 mPa·s at 10° C. and about 2 mPa·s at 40° C. as shown in FIG. 8.

SUMMARY OF THE INVENTION

The inventor conducted an experiment to examine an influence of the changes in the ambient temperature upon the ejecting performance of the recording head. The results of the experiment show that the volume of a portion of the meniscus 230 standing up above the opening edge of the nozzle 206 is decreased as the viscosity of the ink is increased, with the result that the volume of the ejected ink droplet is decreased. On the other hand, the volume of the meniscus portion standing up above the nozzle opening edge is increased as the ink viscosity is decreased, so that continuous application of the pulses to the electrodes results in spray of ink such that normal dots cannot be formed on the recording medium.

More specifically, the recording density is reduced since the volume of the ink droplet is decreased with decrease in the ambient temperature. The increase in the ambient temperature causes the spray of ink and accordingly, reduces the recording quality. The inventor obtained from the results of the experiment a graph of the relationship between the ambient temperature and the recording density. FIG. 7 shows the graph as curve P. FIG. 7 shows that a normal recording is executed in a range between the recording densities k1 and k2. Accordingly, when the ambient temperature is lower than 15° C. or higher than 35° C., the recording density becomes abnormal with the result of reduction in the recording quality.

Therefore, an object of the present invention is to provide an ink jet recording apparatus which can prevent reduction in the recording quality even when the ambient temperature of the apparatus changes.

The present invention provides an ink jet recording apparatus comprising a recording head having a nozzle and, when a drive pulse signal is supplied thereto, driven to eject, from the nozzle, an ink supplied thereto from an ink supply onto a recording medium so that recording is executed, drive means for supplying the pulse signal to the recording head, temperature detecting means for detecting an ambient temperature, and control means for changing a number of pulses of the drive pulse signal corresponding to one record data on the basis of the ambient temperature detected by the temperature detecting means, thereby changing a number of ink droplets expelled from the nozzle.

According to the above-described apparatus, the ambient temperature of the apparatus is detected by the temperature detecting means, and the drive pulse signal corresponding to the one record data is changed on the basis of the detected ambient temperature by the control means. Accordingly, an amount of drive of the recording head such as the number of times of drive is changed according to the ambient temperature. Thus, an amount of ink ejected from the nozzle of the recording head onto the recording medium is automatically changed according to the ambient temperature. Consequently, a reduction in the recording quality due to the changes in the ambient temperature can be prevented. Furthermore, the control means may change a pulse width of the drive pulse signal or an amplitude of the drive pulse signal. In the case where the number of pulses is changed, when the ambient temperature detected by the temperature detecting means is at or below a predetermined value, the control means changes the number of pulses of the drive pulse signal so that the number of pulses is rendered larger than the number of pulses of the drive pulse signal supplied to the recording head in a case where the ambient temperature detected by the temperature detecting means is above the predetermined value.

In another preferred form, the apparatus further comprises storage means for storing data of the ambient temperature detected by the temperature detecting means and data of the number of pulses corresponding to the detected ambient temperature. In this arrangement, the control means reads from the storage means the data of the number of pulses corresponding to the ambient temperature detected by the temperature detecting means, thereby changing the number of pulses of the drive pulse signal.

BRIEF DESCRIPTION OF THE DRAWINGS

Other objects, features and advantages of the present invention will become clear upon reviewing the following description of preferred embodiments thereof, made with reference to the accompanying drawings, in which:

FIG. 4 illustrates a table of the number of pulses;

DETAILED DESCRIPTION OF THE PREFERRED EMBODIMENT

Figure 1:
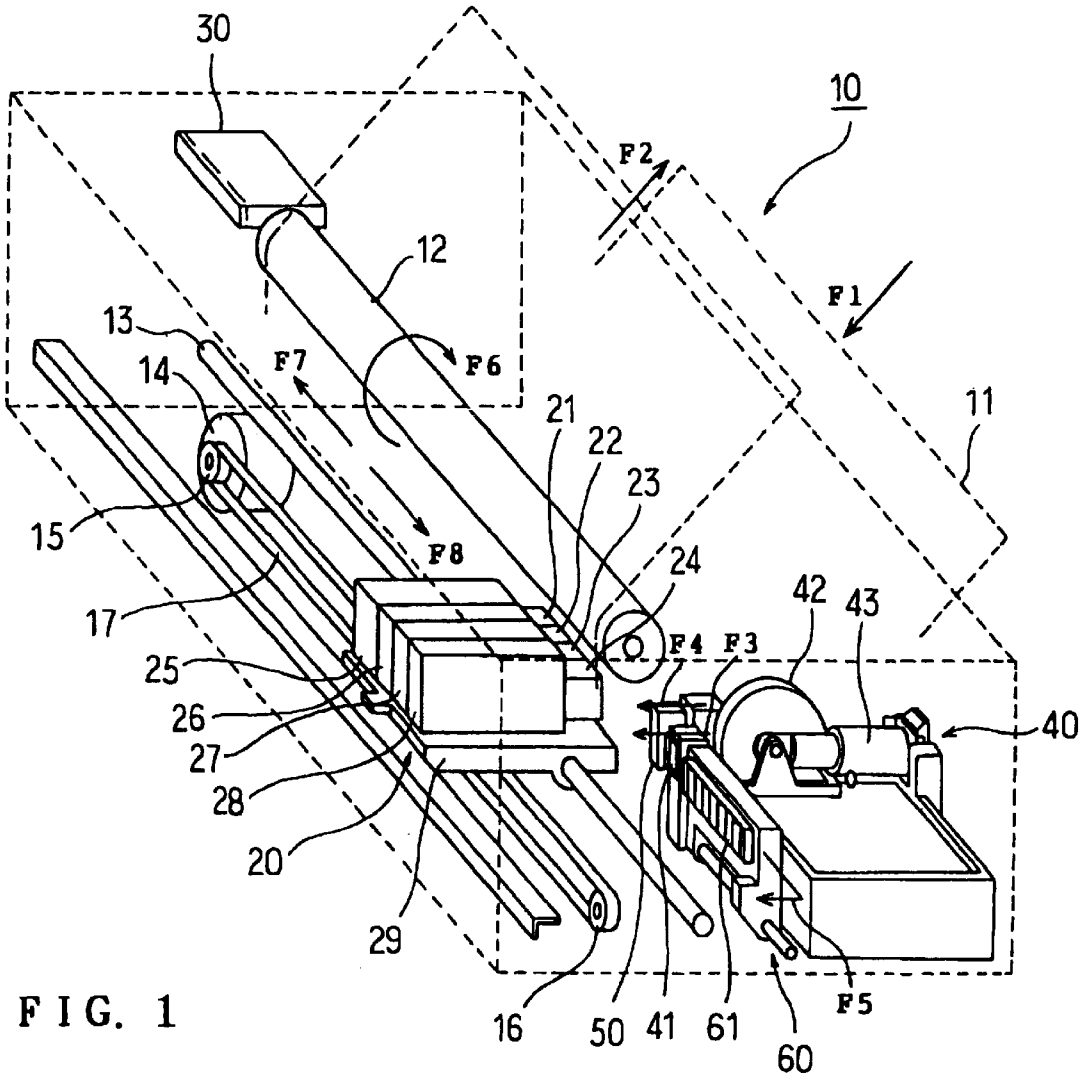
FIG. 1 is a perspective view of the ink jet recording apparatus of one embodiment in accordance with the present invention, the view being partially broken for the purpose of showing an inner mechanism thereof.

One embodiment of the present invention will be described with reference to FIGS. 1 to 8. The ink jet recording apparatus of the embodiment is provided with a shear mode type recording head employing a piezoelectric ceramic material. The ink jet recording apparatus will hereinafter be referred to as "recording apparatus." Referring to FIG. 1, the recording apparatus comprises a platen roller 12. A sheet of recording paper 11 serving as recording medium is first supplied in a direction of arrow F1 in FIG. 1. The recording paper 11 is then fed by the platen roller 12 in a direction of arrow F2. A carriage shaft 13 is provided below the platen roller 12 to be parallel to an axis of the carriage shaft 11. A carriage 29 is mounted on the carriage shaft 13 for rightward and leftward movement. The carriage 29 carries a recording head 20. A carriage motor 14 is disposed below the left-hand end of the carriage shaft 13. A pulley 15 is mounted on a rotational shaft of the carriage motor 14. A pulley 16 is mounted on a shaft (not shown) disposed below the right-hand end of the carriage shaft 13. An endless belt 17 is bridged between the pulleys 15 and 16. The carriage 29 is mounted to the belt 17 so as to be slid on the carriage shaft 13 in the directions of arrows F7 and F8 when the carriage motor 14 is energized to be driven.

Figure 9A:
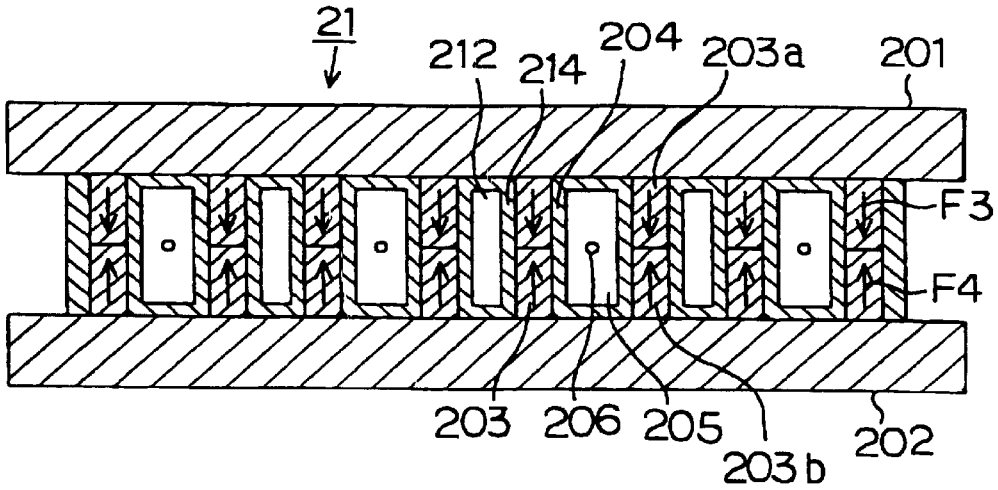
FIG. 9A is a sectional view taken along the plane crossing the length of the ink chamber of the recording head.
Figure 9B:
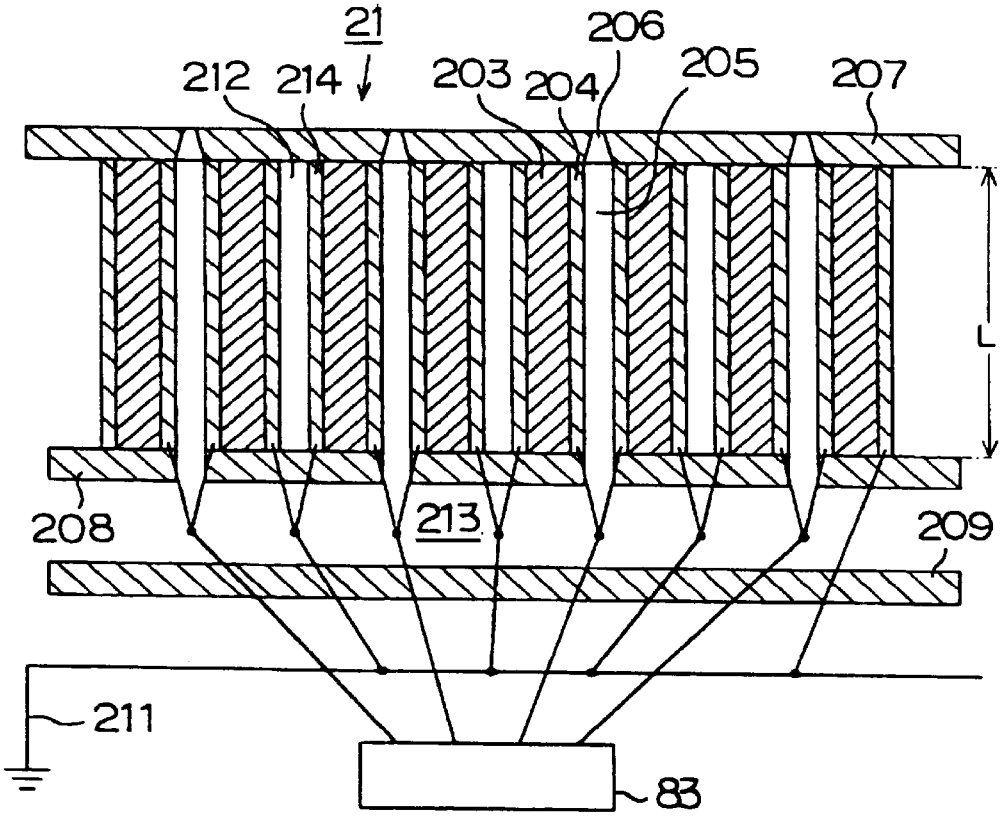
FIG. 9B is a sectional view taken along the length of the recording head.
Figure 10:
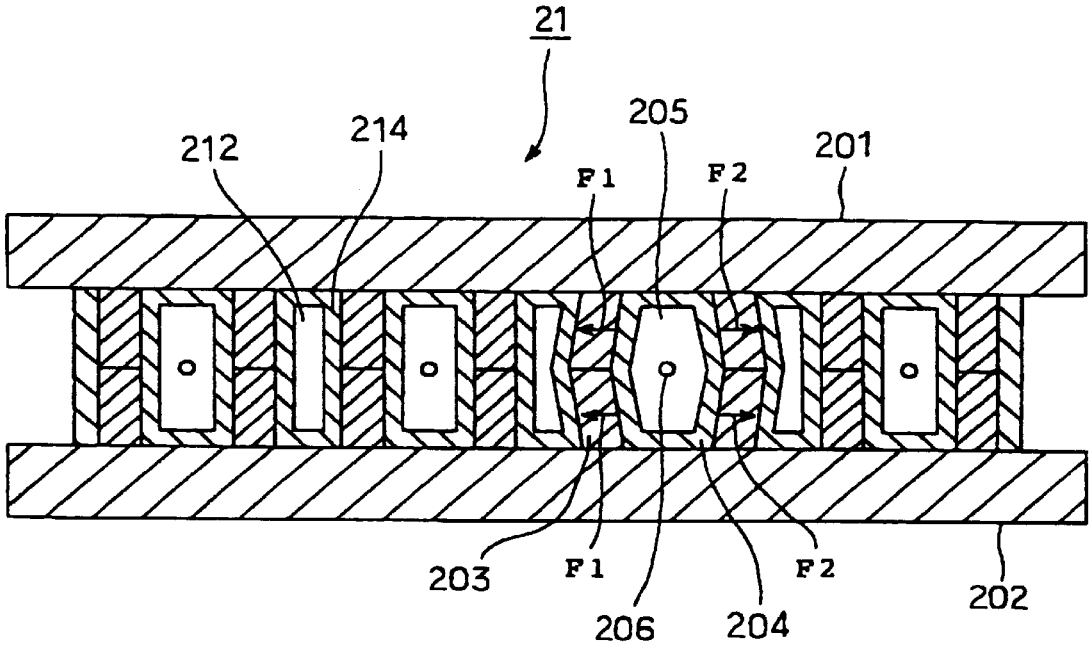
FIG. 10 is a sectional view of the ink chamber of the recording head under the condition where the volume of the ink chamber has been increased.
Figure 11:
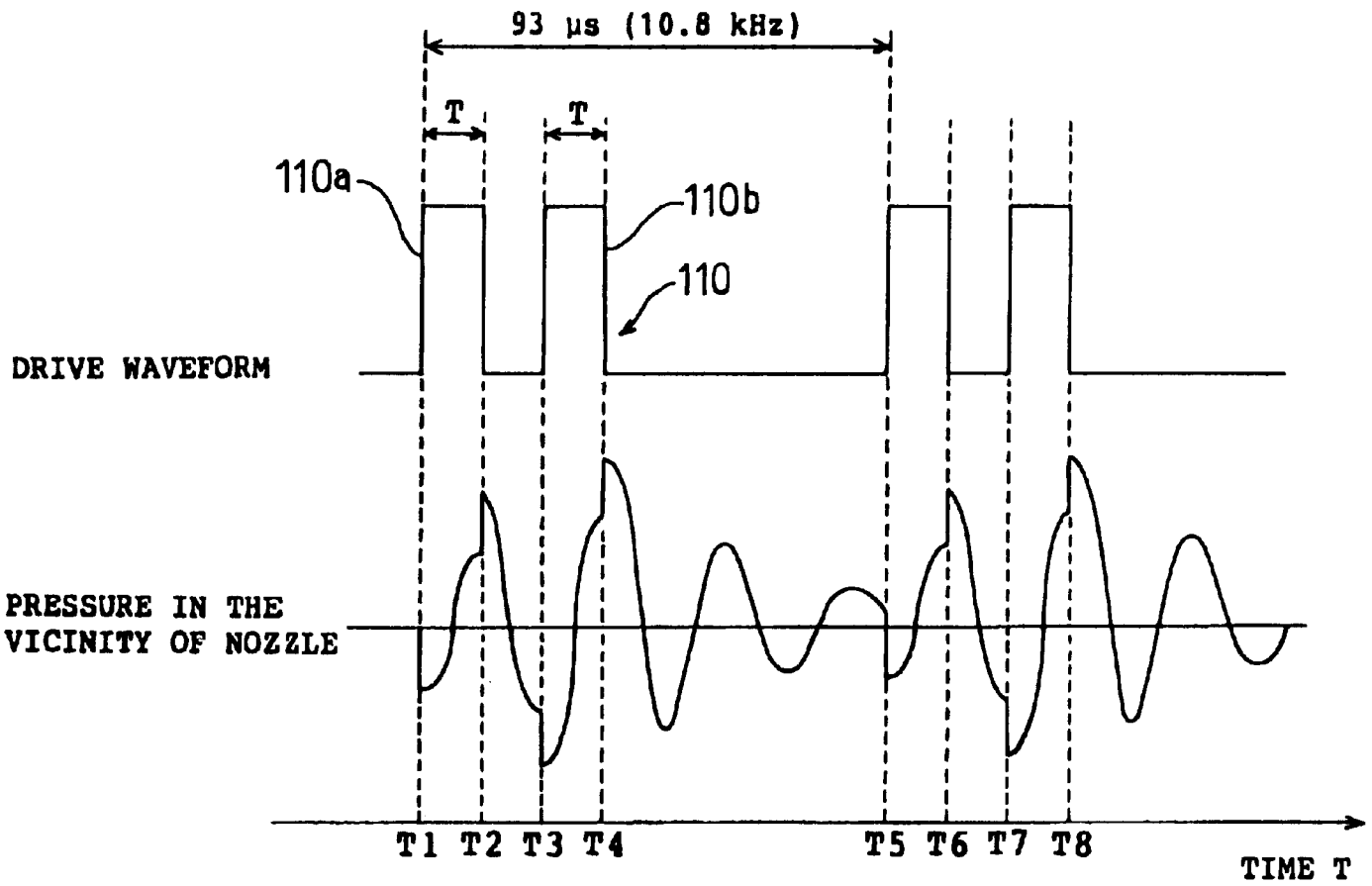
FIG. 11 is a timing chart showing the relationship between the timing for application of the drive pulse signal to the recording head and the pressure induced in the vicinity of the nozzle 206 in the ink chamber 205 by the application of the drive pulse signal.
Figure 12A:
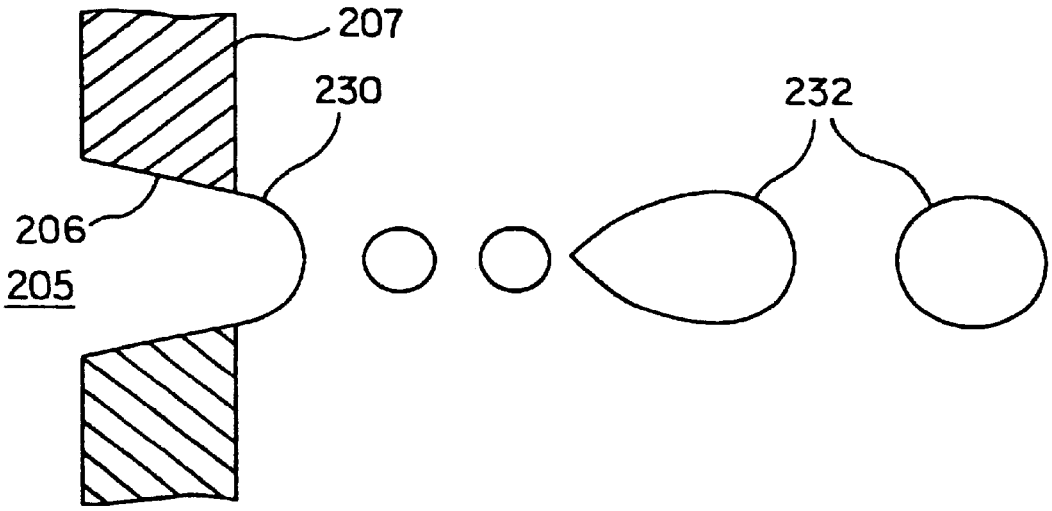
FIG. 12A illustrates a manner of ejection of ink droplets from the nozzle of the recording head.
Figure 12B:
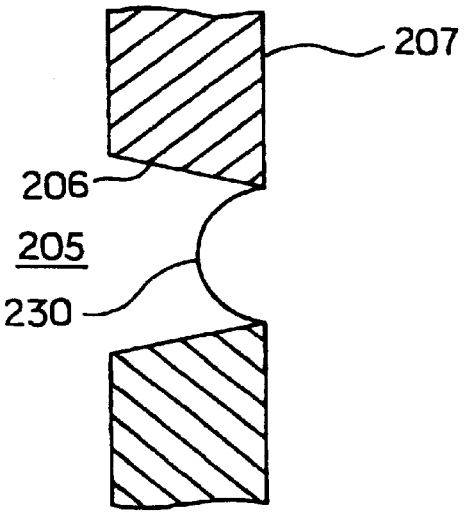
FIG. 12B illustrates meniscus withdrawn into the nozzle.

The recording head 20 is provided with a black ink head 21 for ejecting a black ink, a yellow ink head 22 for ejecting a yellow ink, a cyanic ink head 23 for ejecting a cyanic ink and a magenta ink head 24 for ejecting a magenta ink. The heads 21 to 24 are provided with ink cartridges 25 to 28 serving as ink supply for supplying ink thereto respectively. Since each of the heads 21 to 24 has the same construction as shown in FIGS. 9A to 10, the description of the heads 21–24 is eliminated.

An ink absorbing pad 30 made from a porous material is disposed at the left hand of the platen roller 12 so as to be located outside a recording range for the recording paper 11. The ink absorbing pad 30 absorbs ink ejected from each of the heads 21 to 24 during a flushing executed for recovery of the ejecting performance of each nozzle. Purging means 40 is disposed at the right hand of the platen roller 12 so as to be located outside the recording range for the recording paper 11. The purging means 40 absorbs defective ink from each of the nozzles of the respective heads 21 to 24 to thereby recover the ink ejecting function of each nozzle. The purging means 40 comprises an absorbing cap 41 put onto a side of each head in which the nozzle is formed, a cam 42 for moving the absorbing cap 41 in the direction of arrow F3 in FIG. 1 and a pump 43 for providing negative pressure in the absorbing cap 41.

A wiper 50 is provided at the left hand of the absorbing cap 41 for wiping away the ink or foreign matter adherent on the nozzle side of each of the heads 21 to 24 after the purging. Capping means 60 is provided at the right hand of the absorbing cap 41 for covering with a cap 61 the nozzle side of each head of the recording head 20 returned to its home position, thereby preventing each nozzle from being dried.

Figure 2:
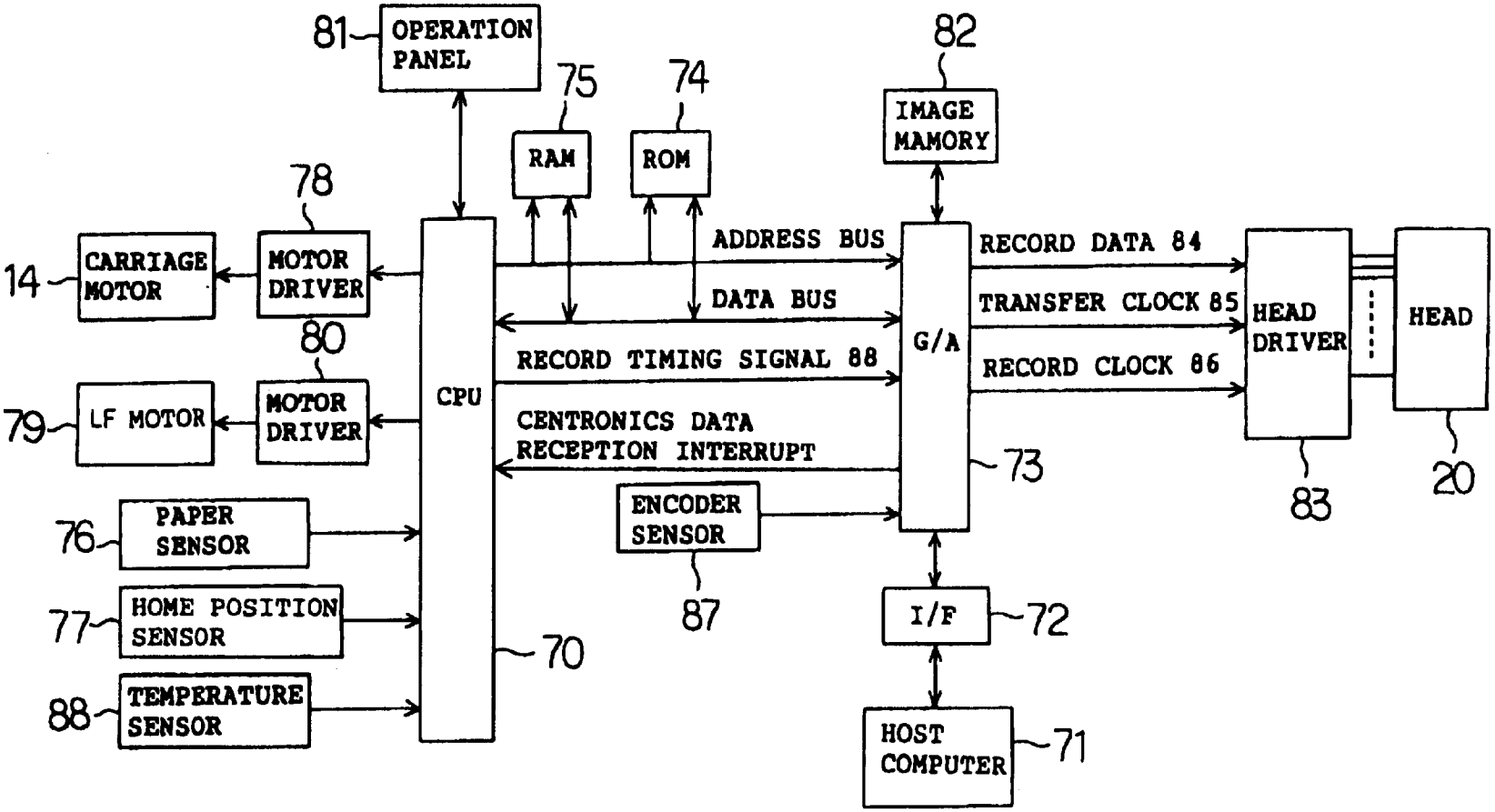
FIG. 2 is an electrical block diagram showing the control system of the apparatus.

Referring now to FIG. 2, an electrical arrangement of the recording apparatus 10 will be described. The recording apparatus 10 comprises a CPU 70 for controlling an entire operation of the apparatus 10 and a gate array 73 receiving via an interface 72 record data transmitted from a host computer 71. The gate array 73 has a function of controlling the development of the received record data to deliver a recording instruction to the recording head 20. A ROM 74 and a RAM 75 are provided between the CPU 70 and the gate array 73 for necessary data input and output between the CPU and gate array. The ROM 74 stores an operation program executed by the CPU 70, a pulse number table as will be described later, etc. and constitutes storage means in the invention. The RAM 75 temporarily stores the above-described data received by the gate array 73.

To the CPU 70 are connected a paper sensor 76 for detecting the presence or absence of the recording paper 11, a carriage home position sensor 77 for detecting occupation of a home position by the carriage 29, and a temperature sensor 88 for detecting an ambient temperature or a temperature in an atmosphere in which the apparatus 10 is installed. The temperature sensor 88 is disposed to be as near to the recording head 20 as possible in a casing of the apparatus 10, so as not to obstruct the recording head 20 and further so as not to adversely affected by noise etc. To the CPU 70 are further connected a first motor driver 78 for driving the carriage motor 14, a second motor driver 80 for driving a line feed (LF) motor 79 for rotation of the platen roller 12, an operation panel 81 including various operation switches delivering switch signals to the CPU, etc.

A head driver IC 83 operates on the basis of the record data 84, transfer clock 85 and record clock 86 delivered from the gate array 73 to thereby drive the recording head 20. An encoder sensor 87 is connected to the gate array 73 for measuring a moving speed of the carriage 29 to determine a timing for recording.

Figure 3:
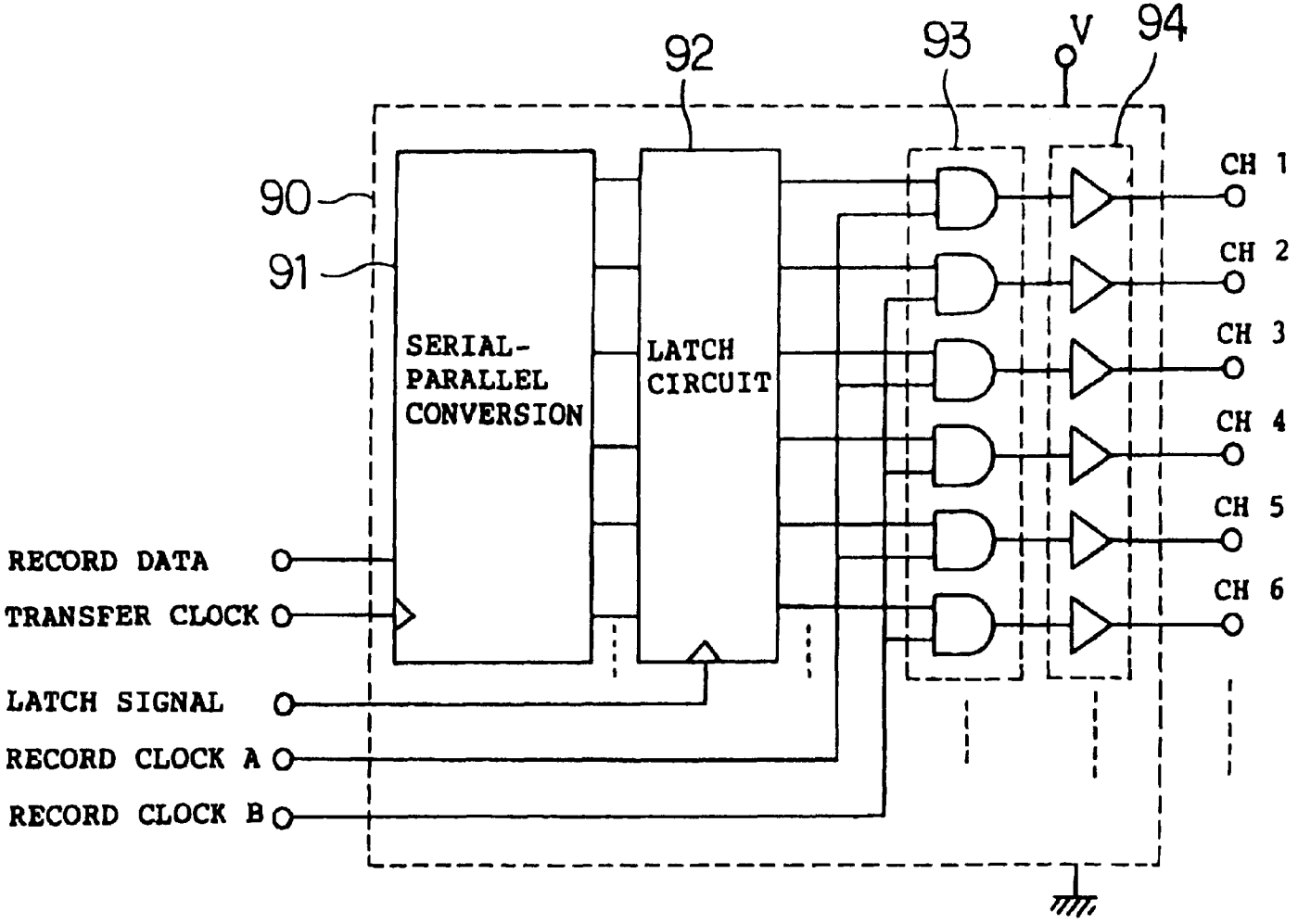
FIG. 3 is a circuit diagram showing drive circuits for channels 1 to 6 of one head.

The arrangement and operation of a drive circuit provided in the head driver IC 83 will now be described with reference to FIG. 3 showing drive circuits for channels 1 to 6 of one head for which 64 channels are provided.

Serial record data delivered from the gate array 73 is supplied to a serial-parallel conversion circuit 91 of a drive circuit 90 so that the serial record data is converted to parallel record data. The converted parallel record data is latched by a latch circuit 92 in synchronism with input of a latch signal. The latched record data is delivered from each of AND gates of an AND circuit corresponding to respective odd channels to an output circuit 94 in synchronism with input of a record clock signal A to each AND gate. Consequently, an ink droplet is ejected from the nozzle corresponding to each of the odd channels 1, 3 and 5. In the same manner as described above, an ink droplet is ejected from the nozzle corresponding to each of even channels 2, 4 and 6 in synchronism with output of a record clock signal B.

The head 20 is thus driven with the channels divided into two groups as described above. This driving manner is employed so that a required electric power is reduced and the temperature of the head driver IC 83 is prevented from being increased. Simultaneous drive of all the channels requires a larger electric power and increases the temperature of the head driver IC 83.

The CPU 70 has a function of changing the number of pulses of a drive pulse signal according to the changes in the ambient temperature. The control contents executed by the CPU 70 for accomplishment of this function will now be described with reference to FIGS. 4 to 6*c*. First, FIG. 4 shows a pulse number table 100 of the ambient temperature T detected by the temperature sensor 88 and the number N of pulses of the record clock which is a drive pulse signal for driving the recording head 20, the number N corresponding to the ambient temperature T. More specifically, as shown in FIG. 4, the pulse number N is 3 when the ambient temperature is in a low temperature range at or below 15° C. The pulse number N is 2 when the ambient temperature is in a normal temperature range above 15° C. and below 35° C. The pulse number N is 1 when the ambient temperature is in a high temperature range at or above 35° C.

When the ambient temperature T is in the low temperature range, the viscosity of the ink is increased such that the volume of a portion of meniscus standing up above the opening edge of the nozzle is decreased. Consequently, the volume of the ink droplet expelled from the nozzle is decreased such that the recording density is reduced. In such a case, the number of pulses in the normal temperature range is increased one for the drive of the recording head 20. Furthermore, when the ambient temperature T is in the high temperature range, the volume of the meniscus portion standing up above the nozzle opening edge is increased. Consequently, a continuous application of the pulses to the electrodes results in spray of ink. In such a case, the number of pulses in the normal temperature range is decreased one for the drive of the recording head 20.

Figure 5:
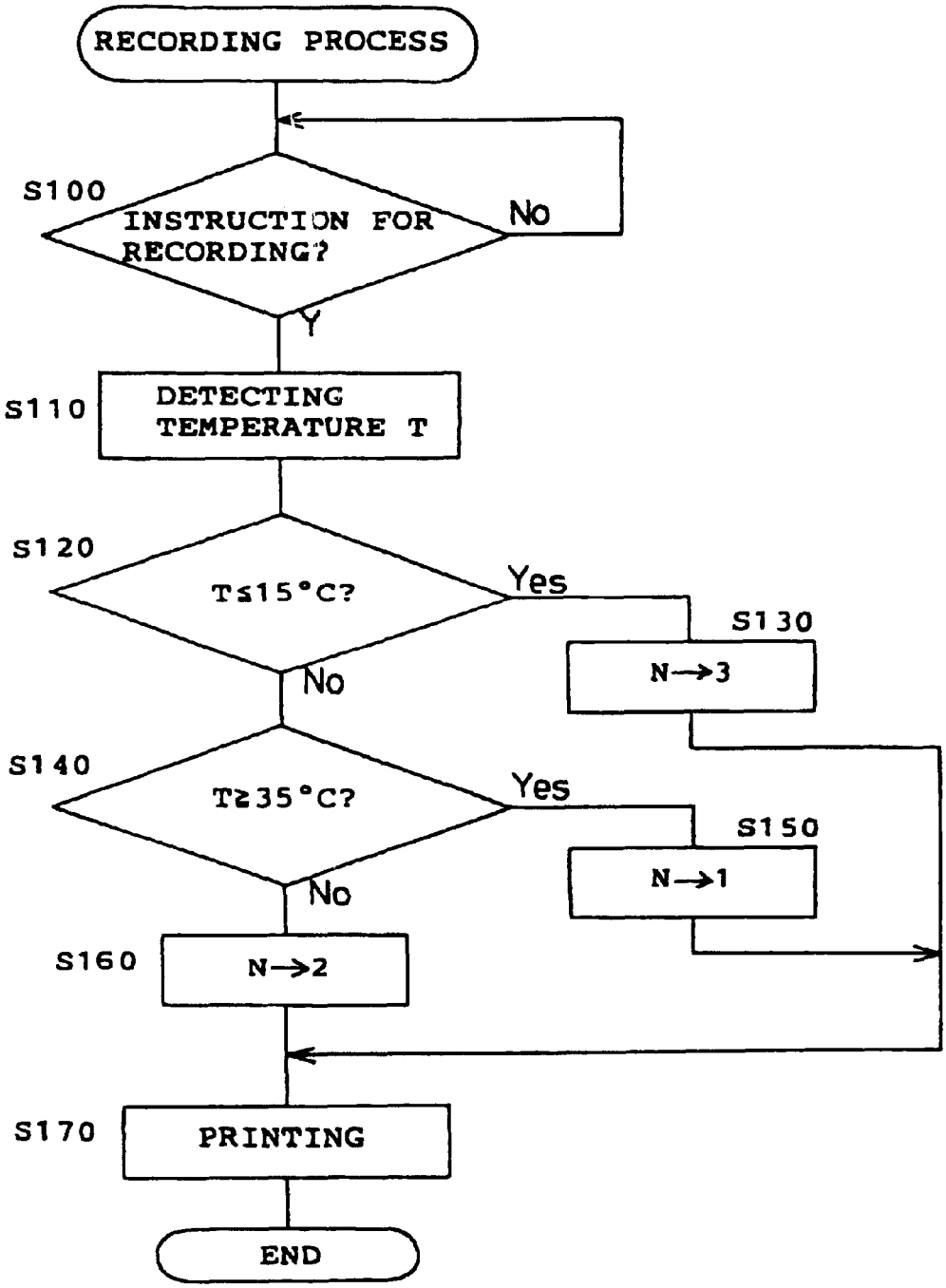
FIG. 5 is a flowchart showing the control contents of the CPU 70.
Figure 6A:
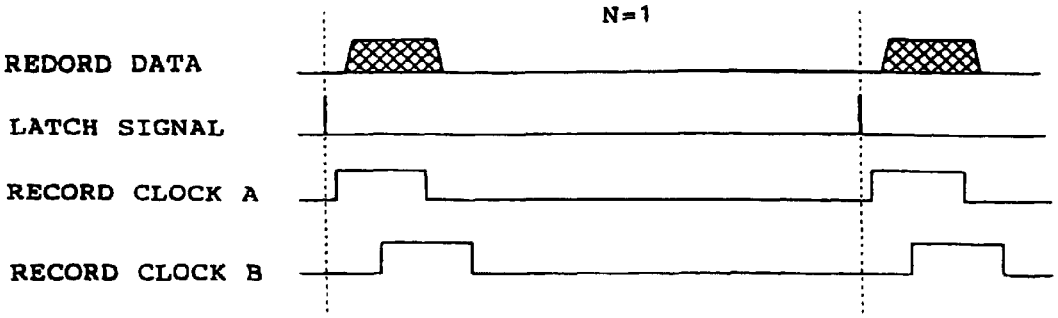
FIG. 6A is a timing chart of the record data, latch signal and record clocks A and B in the case of the record clock having one pulse per record data.
Figure 6B:
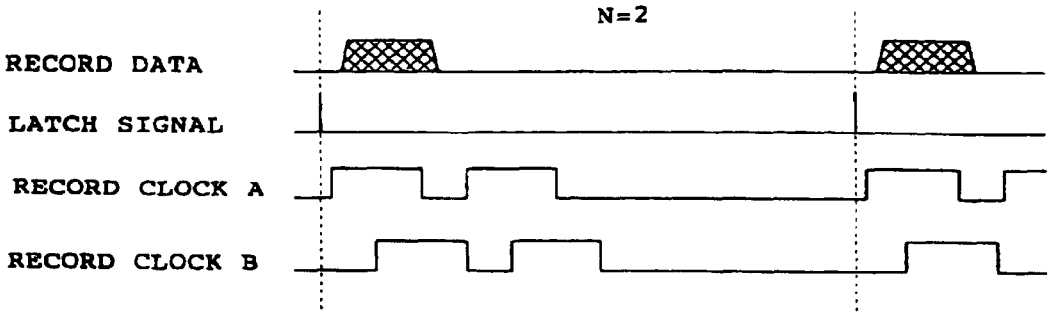
FIG. 6B is a timing chart of the record data, latch signal and record clocks A and B in the case of the record clock having two pulses per record data.
Figure 6C:
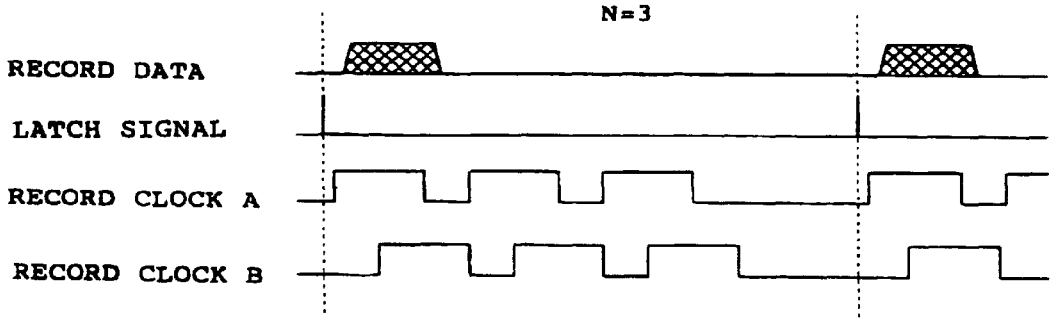
FIG. 6C is a timing chart of the record data, latch signal and record clocks A and B in the case of the record clock having three pulses per record data.

FIG. 5 shows the control contents of the CPU 70. Upon receipt of a recording instruction (step S100), the CPU 70 operates the temperature sensor 88 for detection of the ambient temperature T (step S110). The CPU 70 then judges whether the detected temperature T is at or below 15° C. (step S120). The CPU 70 sets the pulse number N at 3 (step S130) when the temperature T is at or below 15° C. As shown in FIG. 6C, the record clocks A and B each of which has three pulses per record data or one dot are supplied to the recording head 20 so that the head is driven to record the record data (step S170).

Figure 7:
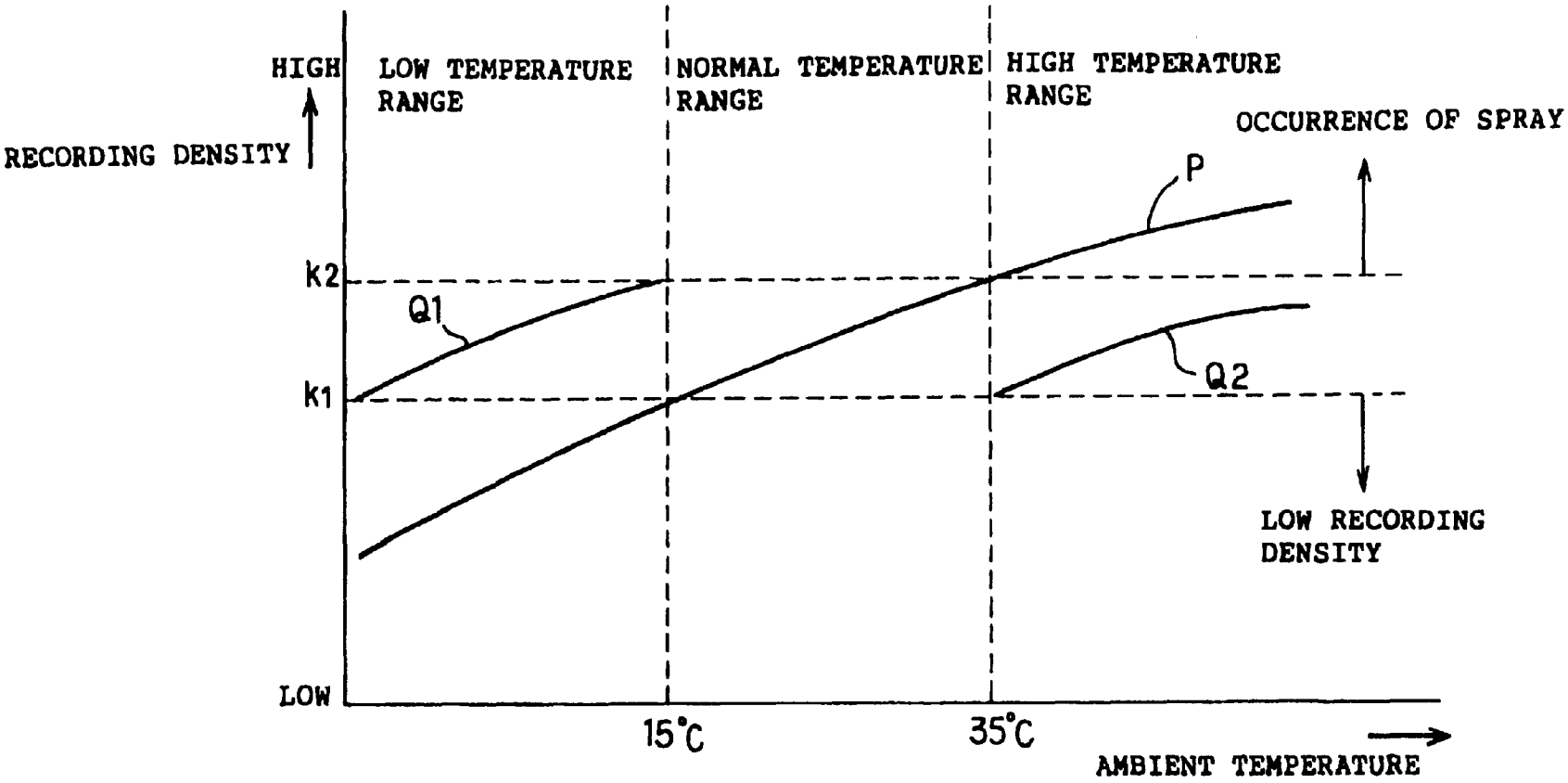
FIG. 7 is a graph showing the experimental results of the relationship between the ambient temperature of the ink and the recording density.
Figure 8:
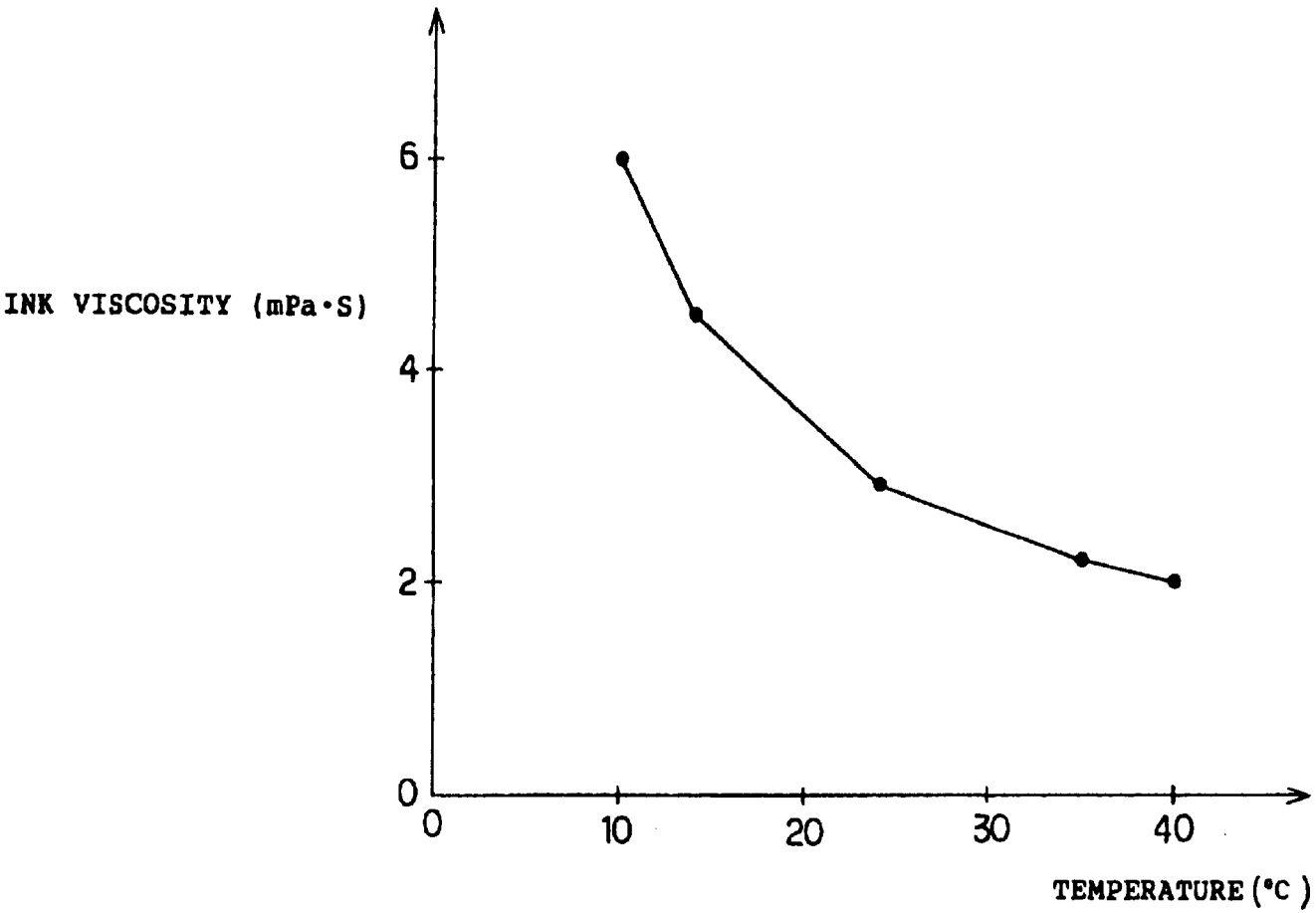
FIG. 8 is a graph showing the relationship between the ambient temperature of the ink and the ink viscosity.

Consequently, each channel of the recording head 20 is driven three times per record data (one dot) so that three ink droplets are ejected from the nozzle onto the recording paper 11. As a result, even when the decrease in the viscosity of the ink reduces the volume of the ink droplet, the three ink droplets can be deposited substantially on the same location on the recording paper 11. Thus, the reduction in the recording density can be prevented. The curve Q1 in FIG. 7 shows the above-described improvement in the recording density. The curve Q1 shows that the recording density is within a range between k1 and k2 or the normal range even when the temperature T is at or below 15° C.

When the temperature T is not at or below 15° C. (NO at step S120), the CPU 70 judges whether the temperature T is at or above 35° C. (step S140). The pulse number N is set at 1 (step S150) when the temperature T is at or above 35° C. As shown in FIG. 6A, the record clocks A and B each of which has one pulse per record data are supplied to the recording head 20 so that the head is driven to record the record data (step S170).

Consequently, each channel of the recording head 20 is driven once per record data so that one ink droplet is expelled from the nozzle onto the recording paper 11. When the volume of the meniscus portion standing up above the nozzle opening edge is increased, a continuous application of the pulses to the electrodes results in spray of ink. However, the occurrence of ink spray can be prevented in the above-described control and accordingly, the reduction in the recording quality due to the ink spray can reliably be prevented. The curve Q2 in FIG. 7 shows the above-described improvement in the recording density. The curve Q2 shows that the recording density is within a range between k1 and k2 or the normal range even when the temperature T is at or above 35° C.

The pulse number N is set at 2 (step S150) when the temperature T is not at or below 15° C. nor at or above 35° C., that is, when the temperature T is in the normal temperature range above 15° C. and at or below 35° C. (NO at step S140). As shown in FIG. 6B, the record clocks A and B each of which has two pulses per record data are supplied to the recording head 20 so that the head is driven to record the record data (step S170). Consequently, each channel of the recording head 20 is driven two times per record data so that two ink droplets are ejected from the nozzle onto the recording paper 11. As a result, the recording with high quality can be executed when the temperature T is in the normal temperature range. The recording density in the normal temperature range is shown by a portion of the curve P in FIG. 7 corresponding to the ambient temperature range between 15° C. and 35° C. The curve P shows that the recording density is within a range between k1 and k2 or the normal range even when the temperature T is between 15° C. and 35° C. The above-described control executed by the CPU 70 or more specifically, the steps S100 to S160 in FIG. 5 function as control means in the invention.

According to the foregoing embodiment, the pulse number of each record clock signal (drive pulse signal) per record data is changed to an optimum value according to the ambient temperature when the ambient temperature of the recording apparatus 10 is varied. Consequently, an amount of ink droplet ejected from the nozzle onto the recording paper 11 can be set at an optimum value, and the occurrence of ink spray can be prevented. Thus, the recording quality can automatically be improved even when the ambient temperature is varied.

In the foregoing embodiment, the ambient temperature is divided into the three temperature ranges. The pulse number is set according to each temperature range. However, the ambient temperature may be divided into a high temperature range and a low temperature range with a room temperature, for example, 25° C. as a demarcation, and the pulse number may be set according to each temperature range, instead. Furthermore, the ambient temperature may be divided into four or more temperature ranges so that the pulse number is set according to each temperature range. In this case, the pulse number is preferably set so that the pulses are not repeated between the record data.

The pulse width of the drive pulse signal is fixed and the pulse number is changed in the foregoing embodiment. However, the pulse number may be fixed and the pulse width may be changed according to the ambient temperature, instead. In this arrangement, too, an amount of ink ejected from the nozzle onto the recording medium is automatically changed according to the ambient temperature. Consequently, the recording quality can be prevented from being reduced by the changes in the ambient temperature. Furthermore, the pulse number and the pulse width may be fixed and the amplitude of the drive pulse signal may be changed according to the ambient temperature. The same effect as in the foregoing embodiment can be achieved in this arrangement, too. Additionally, all the pulse number, pulse width and amplitude (peak value) may be changed according to the ambient temperature.

In the foregoing embodiment, the invention has been applied to the recording apparatus with the recording head of the shear mode type employing the piezoelectric ceramic material. However, the invention may be applied to those of the Kyser type and bubble jet recording apparatus.

The invention has been applied to the recording apparatus connected to the host computer such as a personal computer and provided with the CPU. However, the invention may be applied to a recording apparatus controlled by a CPU of the host computer, instead. For example, the recording apparatus may be composed of a data originating section (host computer) and a recording section (a printer with facsimile function) connected to the data originating section. In this arrangement, the foregoing control is executed by the CPU of the data originating section. A program for operating the data originating section in this manner can be stored in a storage medium from which the computer can read the program, for example, a floppy disk, hard disk system, or CD-ROM.

In the foregoing embodiment, the ROM 74 is provided for storing the program for accomplishing the control means or a program for operating the recording apparatus 10. However, the program may be stored in an external ROM card so that the CPU 70 is operated on the basis of the program stored in the external ROM card. Furthermore, an EEPROM may be provided in the recording apparatus 10. In this case, the program stored in the external ROM card is transferred to the EEPROM and thereafter, the CPU 70 is operated on the basis of the program stored in the EEPROM. Furthermore, a hard disk system and a floppy disk drive system may be provided in the recording apparatus 10 so that the program is stored in the hard drive system. In this case, the program may be stored in a floppy disk so that the program is installed in the hard disk system of the recording apparatus 10 when the floppy disk is inserted into the floppy disk drive system. Furthermore, the program may be stored in a CD-ROM and a CD-ROM drive system may be provided in the recording apparatus 10 so that the program is installed via the CD-ROM into the recording apparatus. A storage medium for storing the program should not be limited to the above-described external ROM card, floppy disk and CD-ROM. Other storage media may be used.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. An ink jet recording apparatus comprising:

a recording head having a nozzle head and, when a drive pulse signal is supplied thereto, driven to eject, from the nozzle, and ink supplied thereto from an ink supply onto a recording medium so that recording is executed;

drive means for supplying the pulse signal to the recording head;

temperature detecting means for detecting an ambient temperature; and control means for changing a number of pulses of the drive pulse signal corresponding to one record data on the basis of the ambient temperature detected by the temperature detecting means, wherein the changing of the number of the pulses results in changing a number of ink droplets ejected from the nozzle.

2. An ink jet recording apparatus of claim 1, wherein the control means changes a pulse width of the drive pulse signal.

3. An ink jet recording apparatus of claim 1, wherein the control means changes an amplitude of the drive pulse signal.

4. An ink jet recording apparatus of claim 1, wherein when the ambient temperature detected by the temperature detecting means is at or below a predetermined value, the control means changes the number of pulses of the drive pulse signal so that the number of pulses is rendered larger than the number of pulses of the drive pulse signal supplied to the recording head in a case where the ambient temperature detected by the temperature detecting means is above the predetermined value.

5. An ink jet recording apparatus of claim 2, wherein when the ambient temperature detected by the temperature detecting means is at or below a predetermined value, the control means changes the pulse width of the drive pulse signal so that the pulse width is rendered larger than the pulse width of the drive pulse signal supplied to the recording head in a case where the ambient temperature detected by the temperature detecting means is above the predetermined value.

6. An ink jet recording apparatus of claim 3, wherein when the ambient temperature detected by the temperature detecting means is at or below a predetermined value, the control means changes the amplitude of the drive pulse signal so that the amplitude is rendered larger than the amplitude of the drive pulse signal supplied to the recording head in a case where the ambient temperature detected by the temperature detecting means is above the predetermined value.

7. An ink jet recording apparatus of claim 1, which further comprises storage means for storing data of the ambient temperature detected by the temperature detecting means and data of the number of pulses corresponding to the detected ambient temperature, and wherein the control means reads from the storage means the data of the number of pulses corresponding to the ambient temperature detected by the temperature detecting means, thereby changing the number of pulses of the drive pulse signal.

8. An ink jet recording apparatus of claim 2, which further comprises storage means for storing data of the ambient temperature detected by the temperature detecting means and data of the pulse width corresponding to the detected ambient temperature, and wherein the control means reads from the storage means the data of the pulse width corresponding to the ambient temperature detected by the temperature detecting means, thereby changing the pulse width of the drive pulse signal.

9. An ink jet recording apparatus of claim 3, which further comprises storage means for storing data of the ambient temperature detected by the temperature detecting means and data of the amplitude of the drive pulse signal corresponding to the detected ambient temperature, and wherein the control means reads from the storage means the data of the amplitude corresponding to the ambient temperature detected by the temperature detecting means, thereby changing the amplitude of the drive pulse signal.

10. An ink jet recording apparatus comprising:

a recording head having a nozzle and, when a drive pulse signal is supplied thereto, driven to eject, from the nozzle, and ink supplied thereto from an ink supply onto a recording medium so that recording is executed;

a drive circuit for supplying the pulse signal to the recording head;

a temperature detecting element for detecting an ambient temperature; and a control circuit for changing a number of pulses of the drive pulse signal corresponding to one record data on the basis of the ambient temperature detected by the temperature detecting means, wherein the changing of the number of the pulses results in changing a number of ink droplets ejected from the nozzle.

11. A storage medium for storing a program for operating an ink jet recording apparatus including a recording head having a nozzle and, when a drive pulse signal is supplied thereto, driven to eject, from the nozzle, an ink supplied thereto from an ink supply onto a recording medium so that recording is executed, and temperature detecting means for detecting an ambient temperature, the program accomplishing the functions of:

drive means for supplying the pulse signal to the recording head; and control means for changing a number of pulses of the drive pulse signal corresponding to one record data on the basis of the ambient temperature detected by the temperature detecting means, wherein the changing of the number of the pulses results in changing a number of ink droplets ejected from the nozzle.

* * * * *